United States Patent [19]

Michienzi

[11] 4,381,853

[45] May 3, 1983

[54] ALIGNMENT APPARATUS

[76] Inventor: Giacomo F. Michienzi, 282 Old Bedford Rd., Concord, Mass. 01742

[21] Appl. No.: 220,354

[22] Filed: Dec. 29, 1980

[51] Int. Cl.[3] ..... E04G 17/04; E04G 17/14

[52] U.S. Cl. ..... 249/205; 249/207

[58] Field of Search ..... 249/195, 196, 207, 165, 249/202, 205, 197

[56] References Cited

FOREIGN PATENT DOCUMENTS 1111334 4/1968 United Kingdom ..... 249/197

1111335 4/1968 United Kingdom ..... 249/197

*Primary Examiner*—John A. Parrish

[57] ABSTRACT

Alignment apparatus for use in erecting shelter structures, the apparatus comprising an eccentrically-shaped cam portion having an endless cam surface extending between first and second faces, a recess disposed in the first face, and a shaft extending from the second face in alignment with the recess, the shaft being adapted to be received in a bore in a vertical wall, the cam surface being adapted to receive and support a portion of a horizontal wall member.

1 Claim, 18 Drawing Figures

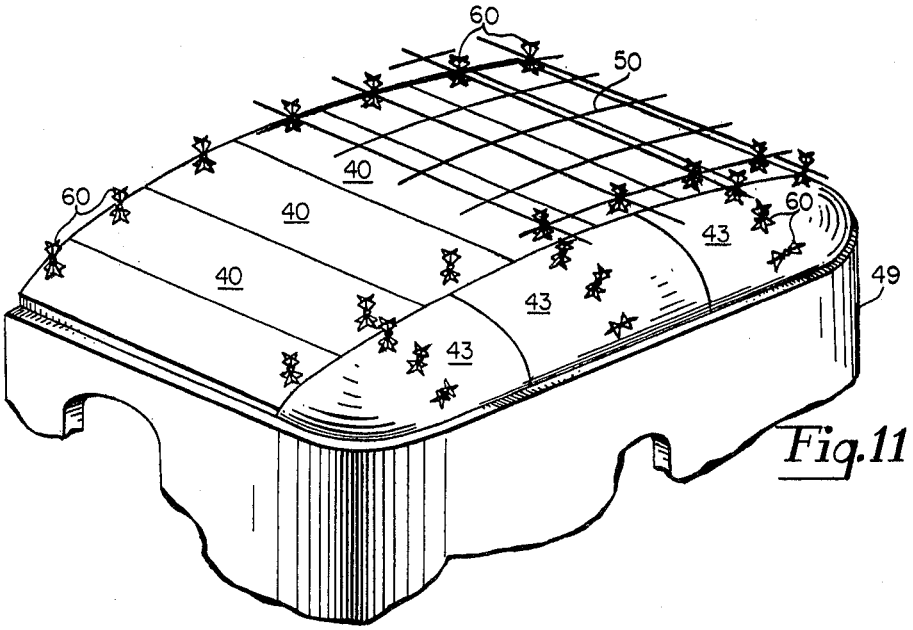
Fig. 11
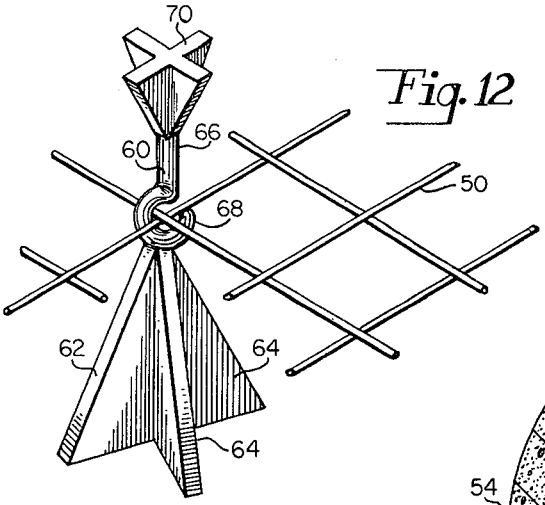
Fig. 12
Fig. 17
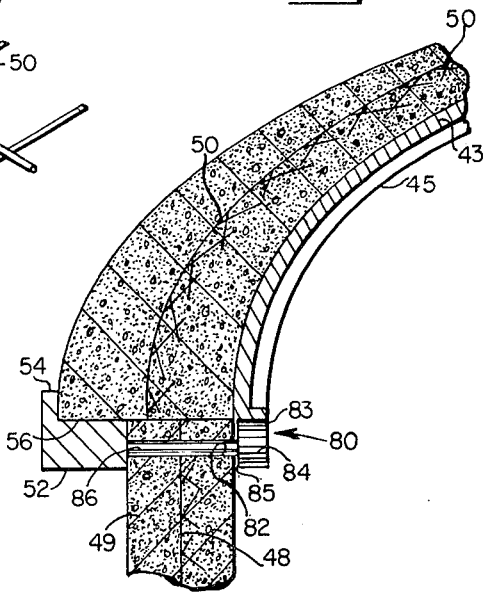

ALIGNMENT APPARATUS

BACKGROUND OF THE INVENTION

1. Field of the Invention

The invention relates to construction tools and is directed more particularly to an alignment or leveler apparatus.

2. Description of the Prior Art

It is customary in the erection of shelter structures that a frame first be erected, the frame serving as the skeleton of the finished shelter. To the frame are added interior and exterior walls, as well as floor and roof elements. While some improvements in construction of shelter structures have been made, by and large, the erection of such structures is still terribly time consuming, requires a great deal of skilled labor, and is unduly expensive.

There has of late been some construction work conducted wherein units are pre-built, of wood or of concrete, and shipped to a destination and there assembled to form the shelter structure. While some savings have been realized at the construction site by such methods, the shipping of large and heavy components, particularly where such are of formed concrete, have to a large degree offset the savings realized at the building site.

Accordingly, there is a need for methods of erecting shelter structures which require little on-site skilled labor, no heavy equipment, and can be consumated with little loss of time and with a minimum of components and complexity. Such is the case particularly in underdeveloped areas where shelter structures are in great demand but skilled labor and craftsmen are lacking, and where heavy equipment is either not available or cannot be transported to remote locations.

SUMMARY OF THE INVENTION

A method for erecting a wall structure and about the wall structure a shelter structure, is described herein, as well as a wall structure and shelter structure made in accordance with the methods disclosed.

An object of the present invention is to provide an alignment apparatus for use in erecting shelter structures in accordance with the methods disclosed.

With the above and other objects in view, as will hereinafter appear, a feature of the present invention is the provision of an alignment apparatus for use in erecting shelter structures, the apparatus comprising an eccentrically-shaped cam portion having an endless cam surface extending between first and second faces, a recess disposed in the first face, and a shaft extending from the second face in alignment with the recess, the shaft being adapted to be received in a core in a vertical wall, the cam surface being adapted to receive and support a portion of a horizontal wall member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings:

FIGS. 9–11 illustrate the positioning of the forms of FIGS. 6–8;

FIG. 12 is a perspective view of a spacer apparatus used in making the roof structure;

FIG. 17 is a partial sectional view further illustrative of the making of the roof portion of a shelter structure.

DESCRIPTION OF THE PREFERRED EMBODIMENT

Figure 1:
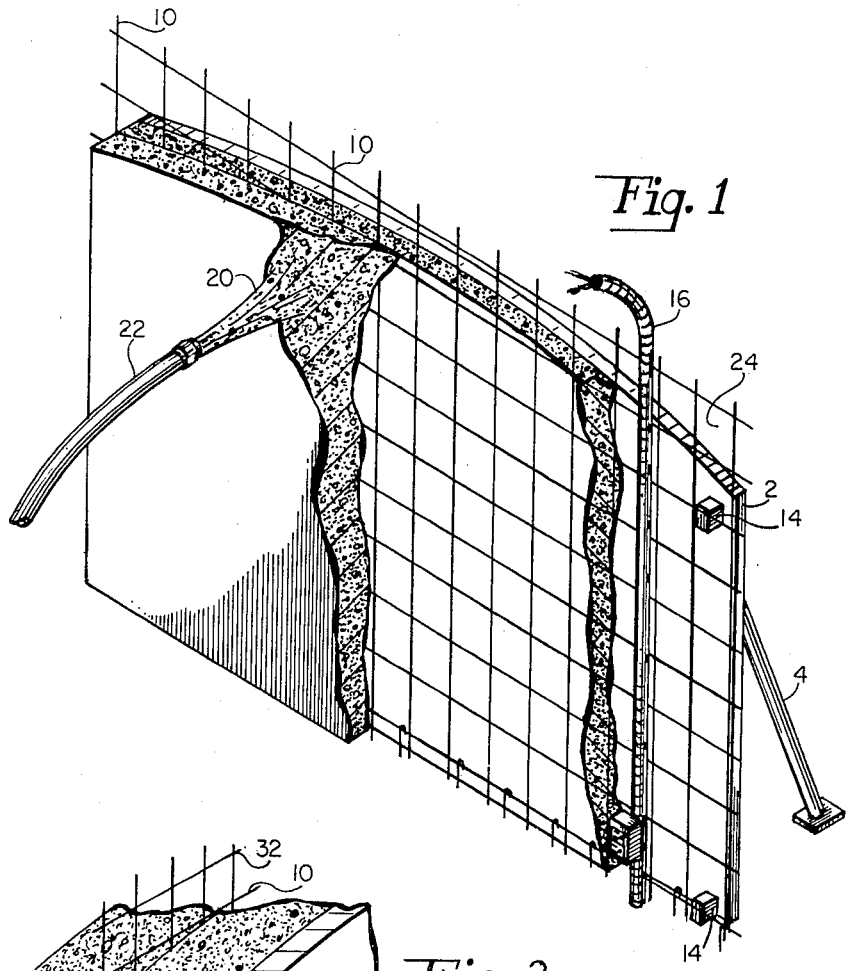
FIGS. 1–4 are perspective views illustrative of a method for erecting a wall structure.

Referring to FIG. 1, it will be seen that in the illustrative method, there is provided a rigid member 2 placed in a position desired for a transverse wall and held in an upright position by any suitable means, as for example, by bracing 4. A mesh panel 10 is placed substantially parallel to, but removed from, the rigid member 2. The mesh panel 10 may be held in place by suitable frame members (not shown) and/or spacer members 14. If desired, conduit members 16 may be attached to the mesh panel 10. The conduit members 16 may take the form of plumbing or electrical conduits, preferably of metal or plastic.

Figure 2:
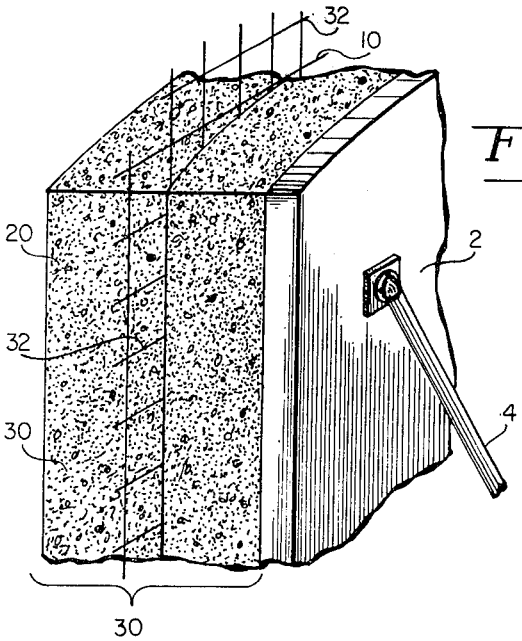

With the rigid member 2 in place and the mesh panel 10 disposed generally parallel to the rigid member, a cementitious material 20 is blown from a discharge nozzle 22 toward the rigid member 2 and the mesh panel 10 from a side of the mesh panel removed from the rigid member, as shown in FIG. 1. Initially, the cementitious material passes through the mesh 10 and accumulates on the inside surface 24 of the rigid member 2. In time, the accumulation of cementitious material exceeds the distance between the rigid member 2 and the mesh panel 10 and continues to be built up, whereby the mesh panel 10, along with any conduit members 16 attached thereto, is embedded in the cementitious material, as shown in FIG. 2.

Figure 3:
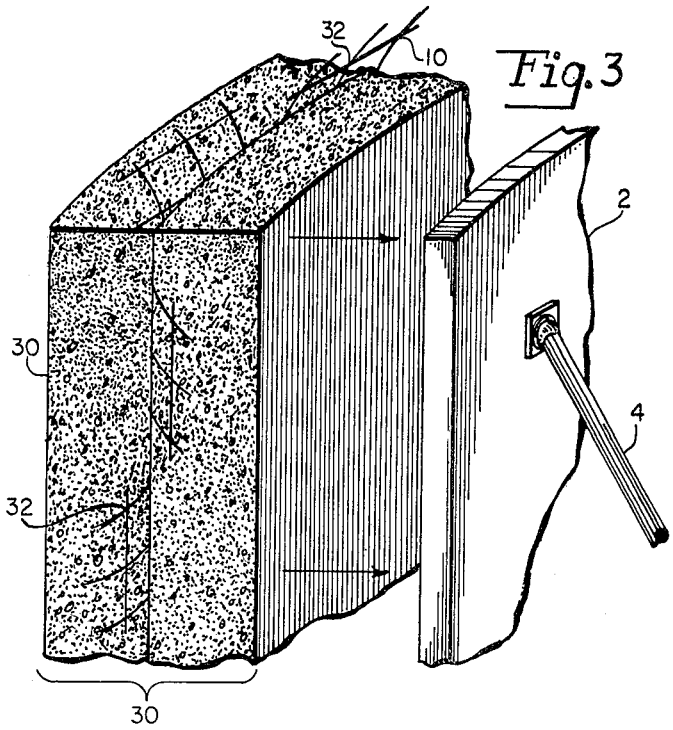
Figure 4:
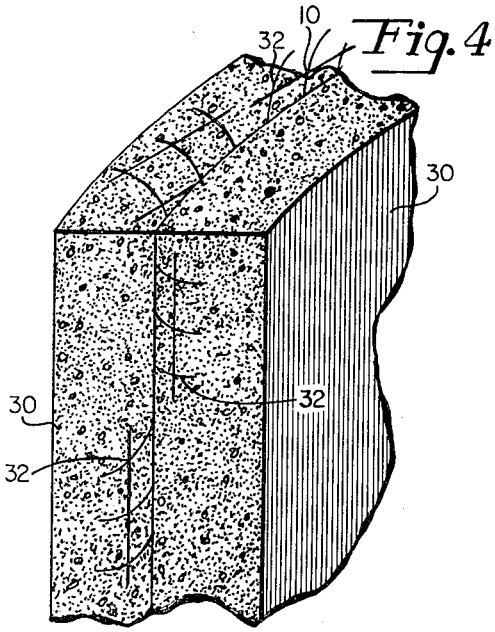

Preferably, the inside surface of the rigid member 2 is covered with a substance permitting ready separation of the rigid member 2 from the hardened cementitious material. After a sufficient lapse of time for hardening of the cementitious material 20 to form a cementitious wall 30, the bracing 4 is removed, and the rigid member 2 is removed, as shown in FIG. 3, leaving the upstanding wall 30 in place (FIG. 4). The mesh panel 10 is bent outwardly as shown in FIGS. 2, 3, and 4, to form outwardly directed tabs 32 at the upper and end edges of the wall 30.

Figure 5:
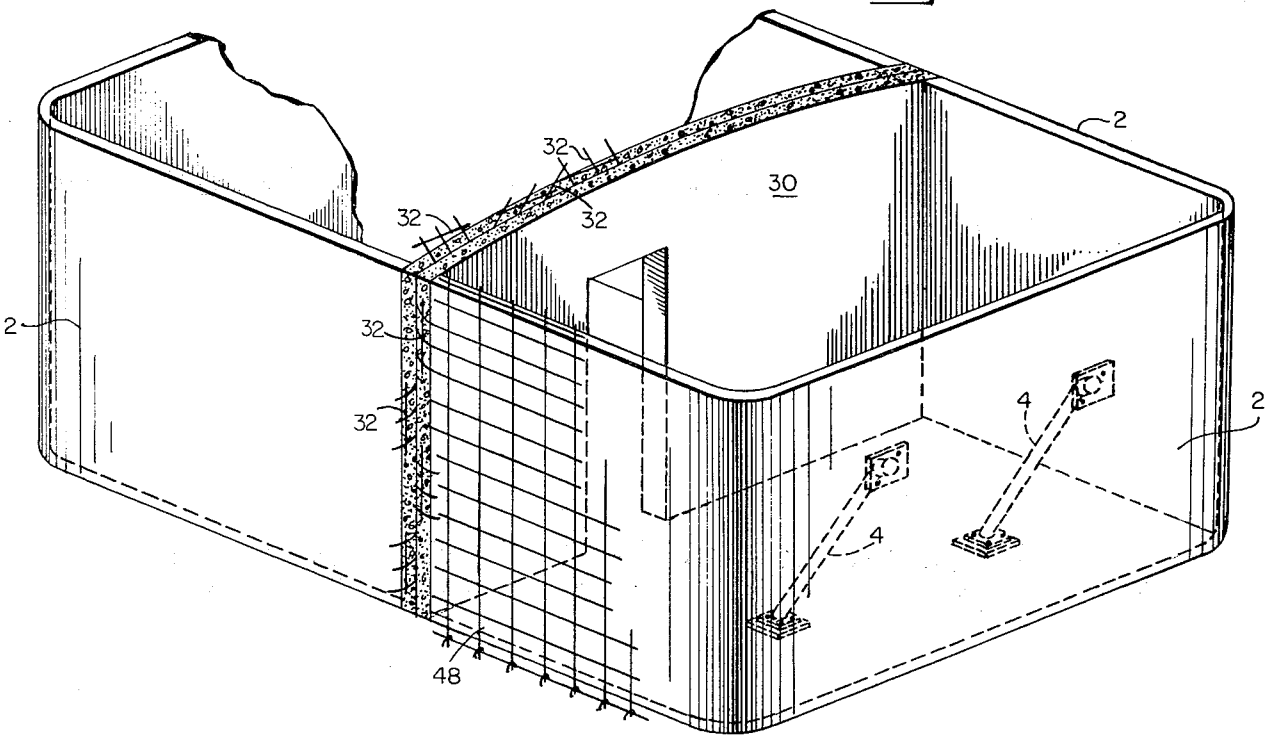
FIG. 5 is a perspective view illustrative of a method for erecting a peripheral wall structure about the transverse wall shown in FIGS. 1–4.

Rigid members 2, which may be plywood sheets, are then placed about the transverse wall 30 and in abutting relationship with the transverse wall, as shown in FIG. 5, to provide a base structure on which to construct the exterior walls. The bracing 4 may be used to retain the rigid members 2 in place, as was done earlier with respect to erection of the interior transverse wall 30.

A second mesh panel 48 is placed proximate to, but removed from, the exterior of the members 2 in much the same manner as described above relative to the construction of the transverse wall 30. The tabs 32 at either end of the wall 30 are intertwined with the second mesh panel 48. A cementitious substance is blown onto the outside surface of the members 2 to imbed the second mesh panel 48 in a peripheral wall 49 thereby formed. Upon hardening of the peripheral wall thus formed, the bracing 4 and members 2 are removed, to leave standing the peripheral wall 49 joined with the transverse wall 30.

Figure 6:
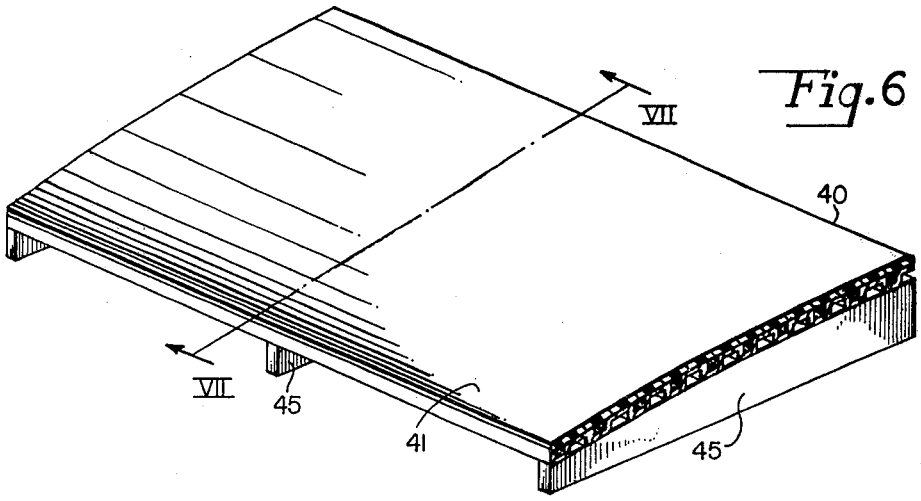
FIGS. 6–8 illustrate forms used in making a roof structure for use in conjunction with the transverse wall of FIGS. 1–4 and the peripheral wall.
Figure 7:
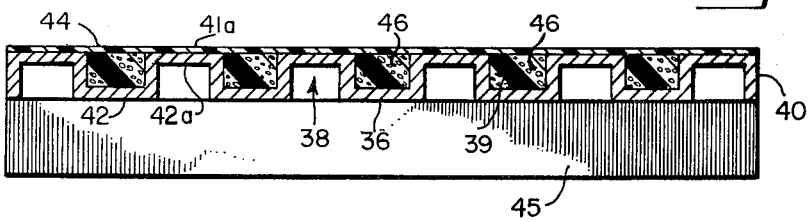

Forms 40, shown in FIGS. 6 and 7 are used to serve as a basis for construction of the roof section of the shelter. The forms 40 each comprise a first metal wall 42 of generally convoluted configuration, and a second wall of plastic material 44 overlying the first wall and co-extensive with the first wall, and connected to the first wall in abutting relationship with portions 42*a* of the first wall 42 forming bottoms of grooves 38. Ridge portions 36 of the first wall 42 and the second wall 44 form elongated pockets 39 in which are disposed foam plastic material 46, the foam material fully occupying the pockets 39. The forms are provided at either end thereof with beams 45 depending therefrom, the beams serving as support members, as will be further described below.

The forms 40 are of two configurations, one (41) shown in FIG. 6, facilitating a gently sloping roof line, and another (41*a*) shown in FIG. 7, for flat roof surfaces. The forms 40 are light of weight, but are rigid and strong enough to support the cementitious matter applied thereto.

Figure 8:
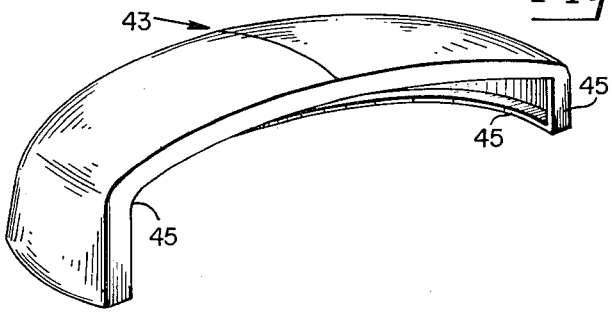

FIG. 8 is illustrative of another embodiment of form 43, preferably constructed of sheet metal and adapted to provide a base for forming end portions of a roof section, as will be further described below. The forms 43 are shaped to provide a roof edge coinciding with the upper edge of the peripheral walls. As in the case of the forms 41 and 41*a*, the form 43 is provided with beams 45 directed inwardly from the edge of the form.

Figure 9:
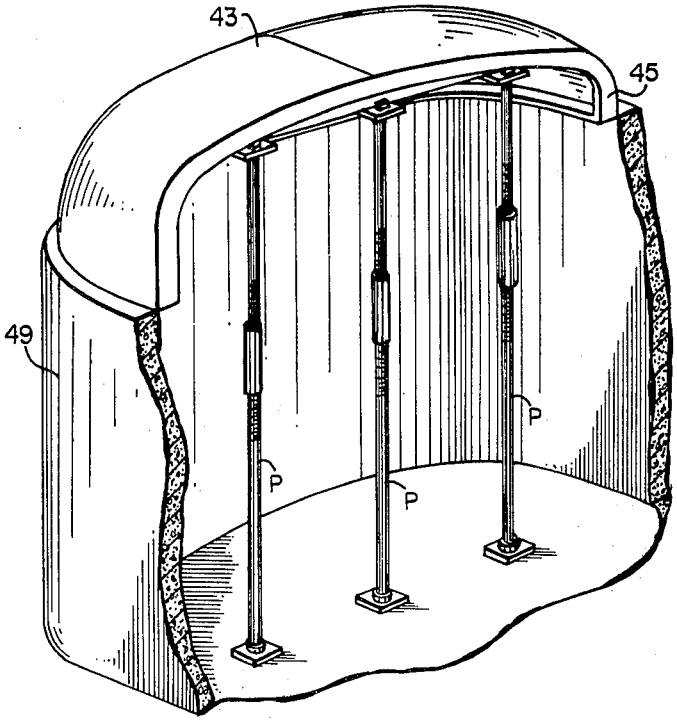
Figure 10:
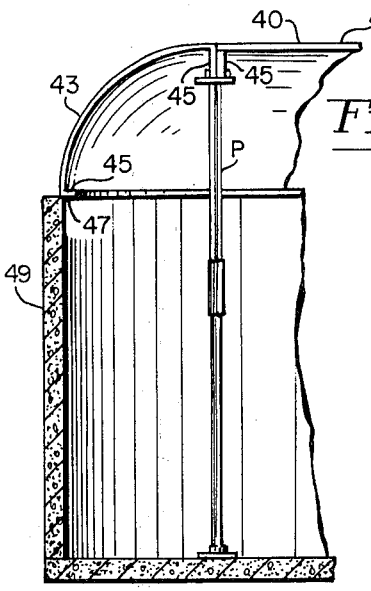

Referring to FIGS. 9 and 10, it will be seen that the forms 43 are placed essentially in alignment with the inside surface of the peripheral wall 49. The forms 43 may be supported at one end by a stud 47 (FIG. 10) attached to the peripheral wall 49. The other end of the forms 43, as well as ends of the forms 41, may be supported by adjustable shores P which are known in the art and which at one end rest upon the ground or floor level, and at the other end support the beams 45 of the forms 40, 43. The forms 40, 43 are assembled as shown in FIG. 11 to form a "shell" in position for formation of a roof structure thereon.

After a "shell" is constructed of the forms 40, 43 a third mesh panel 50 is disposed co-extensive with but removed from the outer surface of the roof shell (FIG. 11). The third mesh panel 50 is intertwined with the upper tabs 32 of the transverse wall 30 (FIG. 5) to securely interconnect the mesh panel 10 and the third mesh panel 50. As with the mesh panel 10, conduit members 16 may be connected, if desired, to the third mesh panel 50.

To retain the third mesh panel 50 at a proper distance from the outer surface of the forms 40, there are provided spacer members 60, shown in FIG. 12. Each spacer member 60 includes a base portion 62 including generally planer fins 64 joined together to form a pyramidal structure having an apex to which is fixed an elongated extension 66. An end of the extension 66 adjacent the base portion 62 is provided with an attachment means 68, which may be a simple hook means, as shown in FIG. 12. A second end of the elongated extension 66 is provided with an enlarged head portion comprising a guide member 70.

Figure 13:
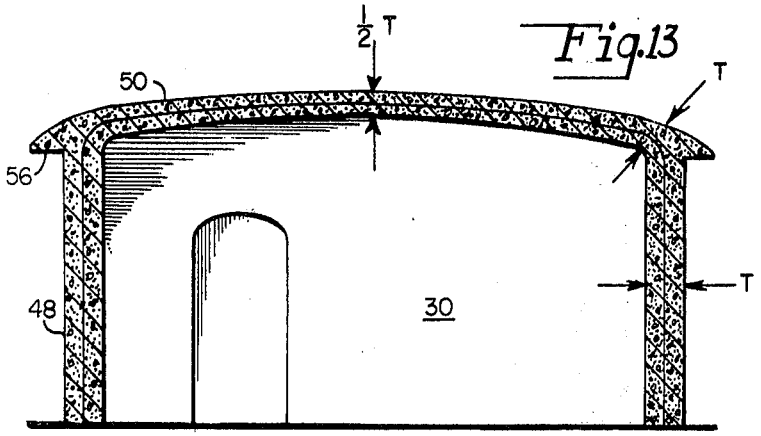
FIG. 13 is a sectional view of a shelter formed in accordance with the disclosed method.
Figure 14:
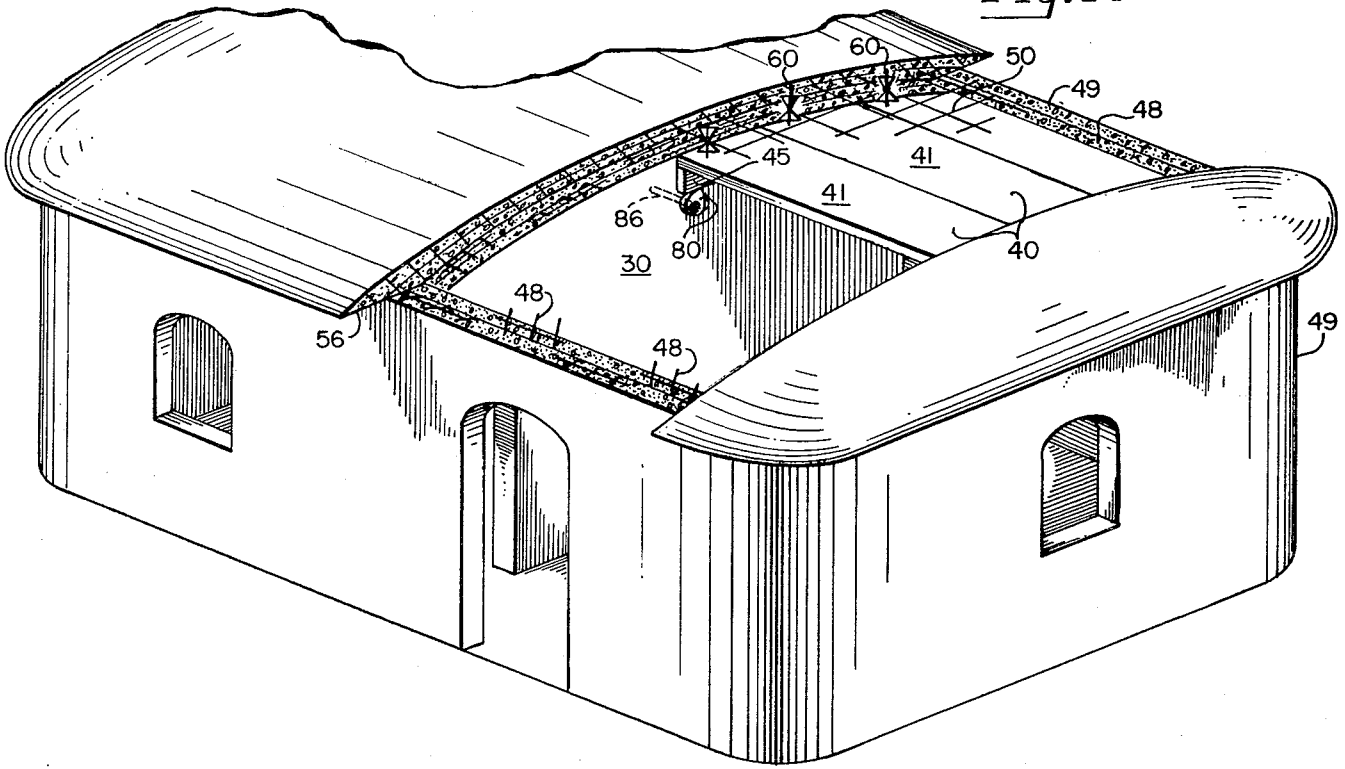
FIG. 14 is a perspective view illustrative of the making of the roof portion of a shelter structure.

Referring to FIG. 11, the spacer members 60 are placed on the roof shell and the third mesh panel 50 is attached to the spacer members 60 (FIGS. 11 and 12) which thereby maintain a prescribed distance between the shell and the third mesh panel, and the third mesh panel and the guide member 70. The guide member 70 on the extension 66 of each spacer element is so disposed as to indicate the desired thickness of the wall or roof at that point. Referring to FIG. 13, it will be seen that it is desirable that the thickness of the roof structure diminish as the roof structure extends inwardly from the peripheral wall, so that at its center the roof structure is approximately one-half the thickness of the peripheral walls. To enable unskilled labor to accomplish this task, the guide members 70 are set to indicate the desired thickness of the roof structure. For example, as the spacer elements are disposed inwardly of the peripheral wall, the guide members 70 would be progressively closer to the base portions 62, so as to indicate a lesser thickness of cementitious material to be applied. The applier of the material projects the material in layers onto the shell and the third mesh structure 50 until the cementitious material reaches the level of the guide members 70 (FIG. 14).

Figure 15:
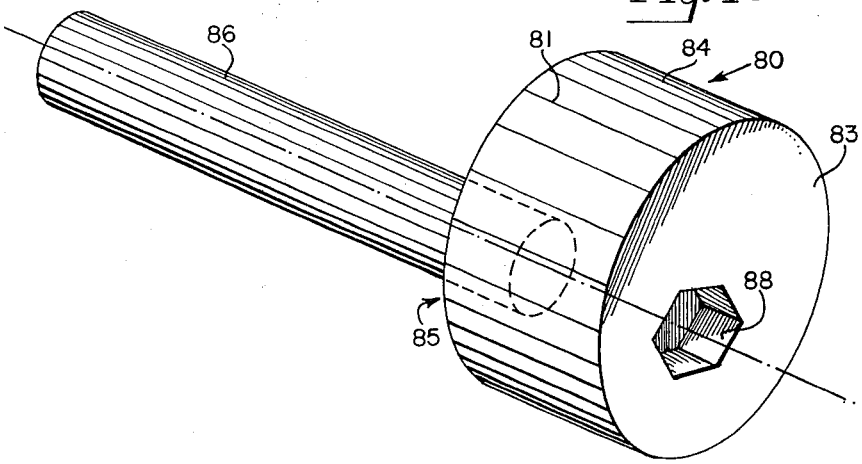
FIG. 15 is a perspective view of an alignment and leveling apparatus used in execution of the disclosed method, and illustrative of an embodiment of the invention.

To ensure that the forms 40 adjacent the wall 30 are properly aligned with the wall 30 there may be provided an alignment apparatus 80 (FIG. 15) by which one may align the forms 40 with the upper edges of the walls 30, 49. In the case of the peripheral wall 49, the alignment apparatus 80 is preferred to the aforementioned stud 47. To facilitate use of the alignment apparatus 80, the walls 30, 49, when formed, are provided with sleeve members 87 defining holes 82 (FIGS. 16, 17) which are adapted to receive the alignment apparatus 80. Each alignment apparatus 80 includes an eccentric cam portion 84 comprising an endless cam surface 81 extending between first and second faces 83, 85. A shaft 86 extends outwardly from the second face 85 and through the hole 82. Each device 80 is provided with a recess means 88, which is preferably a hexagonal recess for receiving a wrench, or the like, therein and which is in alignment with the axis of the shaft 86. Thus, by application of a wrench-like tool, the cam portion 84 may be caused to rotate and thereby alter the position of the cam surface 81 relative to the form 40 resting thereon, thereby to selectively locate the form 40 relative to the wall in which the apparatus 80 is disposed. Thus, an unskilled laborer may simply turn the eccentric cam portion 84 until he sees the form 40 in substantial alignment with the upper edge of the wall 30, 49.

By use of the shores P and the alignment devices 80, the forms 40 are aligned with the walls 30 and 49 and the second mesh panel 48 is intertwined with the third mesh panel 50 (FIG. 17). A platform 52 having a lip 54 may be attached to the exterior of the peripheral wall 49, the platform 52 and the lip 54 forming, in effect, mold members to form a roof overhang 56.

After the forms 40, 43, the spacer members 60, and the third mesh structure 50 are in place, cementitious matter is projected onto the outer surface of the forms 40, 43 until the third mesh structure 50 is imbedded therein. The desired thickness of the roof is indicated to those applying the cementitious matter by the positions of the guide members 70. The cementitious matter is applied until the outer surface of the cementitious matter reaches the level of the upper surface of the guide members. At that point, the application of cementitious matter is discontinued and the inplace material is allowed to cure. After passage of sufficient time, the forms 40, 43 are removed, leaving a monolithic structure having peripheral walls, a roof, and one or more interior transverse walls.

It will be apparent that provision may be made for doors and windows in the various walls by modification of the rigid members and mesh panels to facilitate the formation of openings in the structure.

It will be further apparent that the above described method may be accomplished in large part by unskilled labor following a relatively simple series of steps.

Aside from ordinary level indicators, little in the way of additional tooling and virtually no heavy equipment is required to facilitate the erection of basic shelters.

Figure 18:
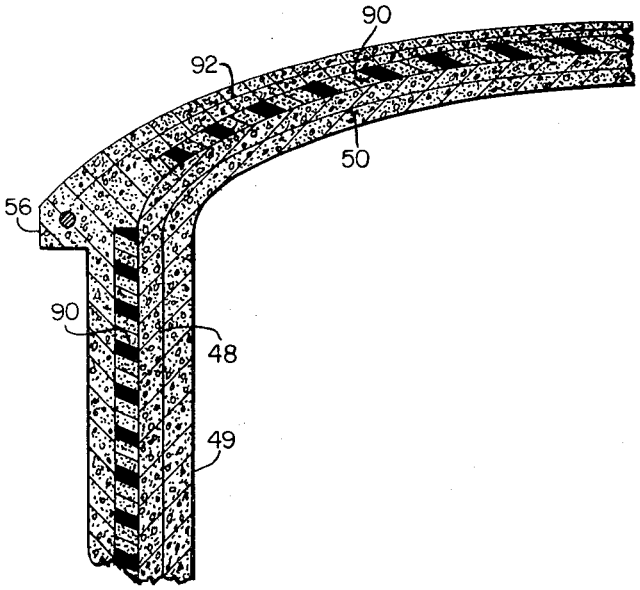
FIG. 18 is a sectional view of an alternative embodiment of wall and roof structure.
Figure 16:
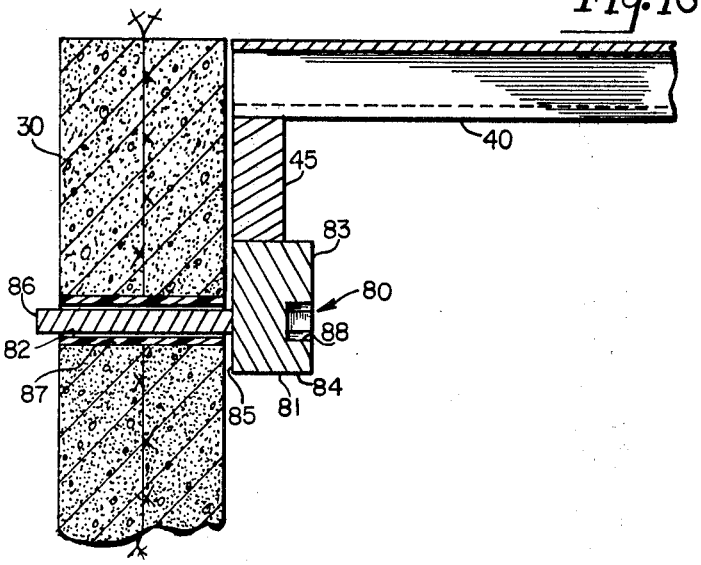
FIG. 16 is a sectional view illustrative of the device of FIG. 15 in its operative position.

FIG. 18 is illustrative of an alternative embodiment of the invention. There may be projected onto the cementitious walls and/or roof, a layer of insulative material 90. After setting of the insulative material 90, there is applied further cementitious material. An additional mesh panel 92 may be placed outwardly of the insulative layer 90 and again subjected to projection of cementitious material until the additional mesh panel 92 is embedded. In the FIG. 16 illustration, the additional mesh is shown in conjunction with the roof structure only, but may be incorporated in the wall structures as well.

It is to be understood that the present invention is by no means limited to the particular construction and method herein disclosed and/or shown in the drawings, but also comprises any modifications or equivalents within the scope of the disclosure.

Having thus described my invention what I claim as new and desire to secure by Letters Patent of the United States is:

1. An alignment apparatus for use in erecting shelter structures, said apparatus comprising an eccentrically-shaped cam portion having an endless cam surface extending between first and second faces, a shaft portion extending outwardly from said second face of said cam portion, recess means disposed in said first face of said cam portion, said recess means being in alignment with the axis of said shaft portion, and a sleeve member adapted to receive said shaft portion and adapted to be embedded in a formed, vertical wall, said cam portion second face being disposed proximate to and parallel with a surface of said vertical wall, and normal to said sleeve member, when said shaft is disposed in said sleeve member, said cam surface being adapted to receive and support a portion of a horizontal member, said recess means being adapted to receive a complementarily-shaped tool, whereby said cam portion may be rotated by use of said tool to rotate said shaft portion in said sleeve member and to selectively locate said cam surface relative to said horizontal member and thereby selectively locate said horizontal member relative to said vertical wall member.

* * * * *